United States Patent [19]

Ingram

[11] 3,994,751

[45] Nov. 30, 1976

[54] SOLVENT-BASED ACTIVATOR FOR ENSURING PAINT ADHESION TO TITANIUM AND STAINLESS STEEL

[75] Inventor: Alvin H. Ingram, Chesapeake, Va.

[73] Assignee: The United States of America as represented by the Secretary of the Navy, Washington, D.C.

[22] Filed: Oct. 28, 1975

[21] Appl. No.: 626,432

[52] U.S. Cl. ..... 148/6.14 R; 252/171; 252/143; 427/327

[51] Int. Cl.[2] ..... C23F 7/00

[58] Field of Search ..... 252/143, 171; 148/6.14 R; 427/327

[56] References Cited

OTHER PUBLICATIONS

Brynza et al., Chem. Abstracts 70:10240/u 1969.

*Primary Examiner*—Ralph S. Kendall

[57] ABSTRACT

A solvent, organic acid and controlled water content mixture for wiping titanium and stainless steel surfaces just prior to painting. The mixture contains xylene, galacial acetic acid, alcohol, (selected from 2-propanol, n-propanol, methanol or ethanol), water, methyl orange and a paint thinner (selected from methyl ethyl ketone, toluene, methyl isobutyl ketone, ethyl acetate or other conventional lacquer-type solvents).

1 Claim, No Drawings

SOLVENT-BASED ACTIVATOR FOR ENSURING PAINT ADHESION TO TITANIUM AND STAINLESS STEEL

BACKGROUND OF THE INVENTION

High adhesion and generally good performance of polyurethane paint is, to a large degree, dependent on thorough (and timely) surface preparations and application techniques. When the polyurethane paint is to be applied over bare metal surfaces, proper chemical surface treatment must be applied. Dwell time limits after chemical treatment must be observed.

For many planes, there is a requirement that the exterior portion be painted. This is necessary for anti-glare or for a camouflage scheme. The surface of the plane may be a combination of abutting materials such as titanium, stainless steel, aluminum and magnesium. On the F-8 aircraft, there has been a chronic history of paint failure on the titanium hot spot (in and around the exhaust tail cone). The painted surface is constantly taxed due to the heat from the cone with resultant paint peelage. In painting the exterior of an F-8 aircraft, the entire plane is prepared by conventional chromate conversion coatings using an aqueous solution. The plane is rinsed and then dried. Since paint does not adhere well in high humidity areas, the plane must be moved or the area allowed to dry. There is also the masking of certain areas such as the canopy and landing gear. All of this takes time. As long as the plane is painted within 24 hours of its aqueous solution, the aluminum and magnesium areas are receptive to the paint. Titanium and stainless steel, however, are time sensitive and lose their activity or receptivity to organic coatings. Re-treatment of titanium and stainless with water-based solutions is messy and requires a drying step which causes the loss of receptivity to recur.

SUMMARY OF THE INVENTION

The invention is a solvent, organic acid and a controlled water content mixture for wiping titanium and stainless steel surfaces just prior to painting. This technique enables painters to include chemical activation as a part of the normal, customary solvent wiping. This eliminates water-based activation techniques which would interfere with, contaminate or complicate operations to surrounding materials, equipment or environment of other pieces of gear being painted.

DETAILED DESCRIPTION OF THE PREFERRED EMBODIMENT

This invention is used to upgrade the adhesion ability of titanium and stainless steel to accept an organic coating. The invention is applied to titanium and stainless steel surfaces just prior to painting.

The solvent, organic acid and controlled water content mixture is prepared as a concentrate which is added to wipe-down solvents. The concentrate is prepared approximately as follows: (1) prepare a 1/10,000 (WT/V) mixture of methyl orange indicator in an alcohol selected from 2-propanol, n-propanol, methanol or ethanol, but containing less than 1% (by wt.) water; (2) measure one volume of xylene into a container; (3) add one volume of galacial acetic acid and mix. (4) add one volume of methyl orange-alcohol mixture (above) and mix; (5) add, to 100 volumes of above mixture, 3 volumes of distilled water. This mixture is the concentrate.

(6) Dilute the above concentrate by adding one volume of concentrate to 50 volumes of paint thinner selected from methyl ethyl ketone, toluene, methyl isobutyl ketone, ethyl acetate or other conventional lacquer-type solvents. The composition variations of the invention are shown in the following table:

| Ingredient | Tolerable Composition Variations |
|---|---|
| methyl orange | 0.005–0.01 wt % (.005 nominal) |
| alcohol | 0.5–1.0 vol % (0.64 nominal) |
| xylene | 0.5–1.0 vol % (0.64 nominal) |
| galacial acetic acid | 0.5–1.0 vol % (0.64 nominal) |
| water | 0.02–0.10 vol % (0.06 nominal) |
| paint thinner | balance of volume (to reach 100%) |

The titanium and/or stainless steel areas may be hand-wiped with the invention. The two-rag technique of wiping with the solvent-laden rag first and immediately following with a dry rag could be used. The operation must be scheduled so that this procedure is completed and painting begun within one-half hour.

EXAMPLE

The concentrate was prepared as follows:

1. 0.05 grams of methyl orange indicator was mixed in 500cc of 2-propanol.
2. 200cc of xylene was measured into a glass container;
3. 200cc of galacial acetic acid was added and mixed;
4. 200cc of methyl orange-propanol mix (above) was added and mixed; and
5. to this 600cc mixture, 18cc of distilled water was added and mixed. This mixture was the concentrate.
6. To dilute the concentrate as needed for use, one volume of concentrate was added to 50 volumes of MIL-T-19544, an acrylic nitrocellulose thinner (a blend of ethylene glycol monobutyl ether, xylene, methyl isobutyl ketone and toluene).

Just prior to painting, the above solvent was wiped down on all titanium and stainless steel skins of the F-8 aircraft with a lint free cloth. The two-rag technique of wiping with the solvent-laden rag first and immediately following with a dry rag was performed. Painting with an aliphatic polyurethane paint system was begun within one-half hour. Paint adhesion was achieved.

Obviously many modifications and variations of the present invention are possible in light of the above teachings. It is therefore to be understood that within the scope of the appended claims the invention may be practiced otherwise than as specifically described.

What is claimed is:

1. A material for upgrading the adhesion ability of titanium and stainless steel surfaces to accept an organic coating comprising:

0.005-0.01 wt % of methyl orange;

0.5-1.0 vol. % of alcohol selected from the group consisting of 2-propanol, n-propanol, methanol and ethanol (containing less than 1% by wt. water);

0.5-1.0 vol. % of xylene;

0.5-1.0 vol. % of galacial acetic acid;

0.02-0.10 vol. % of water; and, balance of volume to reach 100% of paint thinner selected from the group consisting of methyl ethyl ketone, toluene, methyl isobutyl ketone, ethyl acetate and lacquer type solvents.

* * * * *